US008104116B2

(12) United States Patent
Johnson-Jones

(10) Patent No.: US 8,104,116 B2
(45) Date of Patent: Jan. 31, 2012

(54) SLEEPING UNIT

(75) Inventor: Emily Johnson-Jones, Somerset (GB)

(73) Assignee: Mr. Smiles Ltd, Somerset (GB)

( * ) Notice: Subject to any disclaimer, the term of this patent is extended or adjusted under 35 U.S.C. 154(b) by 55 days.

(21) Appl. No.: 12/596,502

(22) PCT Filed: Apr. 21, 2008

(86) PCT No.: PCT/GB2008/001408

§ 371 (c)(1),
(2), (4) Date: Nov. 25, 2009

(87) PCT Pub. No.: WO2008/129294

PCT Pub. Date: Oct. 30, 2008

(65) Prior Publication Data

US 2010/0125948 A1 May 27, 2010

(30) Foreign Application Priority Data

Apr. 19, 2007 (GB) ..... 0707581.5
Jul. 12, 2007 (GB) ..... 0713491.9
Jul. 12, 2007 (GB) ..... 0713493.5
Jul. 24, 2007 (GB) ..... 0714423.1

(51) Int. Cl.
*A47D 7/01* (2006.01)
*A47D 11/00* (2006.01)

(52) U.S. Cl. ..... 5/93.2; 5/280; 5/285; 5/2.1

(58) Field of Classification Search ..... 5/2.1, 93.2, 5/53.1, 280, 907, 285, 11, 131, 132, 9, 93.1, 5/100, 400

See application file for complete search history.

(56) References Cited

U.S. PATENT DOCUMENTS

| | | | | |
|---|---|---|---|---|
| 3,299,450 | A * | 1/1967 | Gottfried et al. | 5/100 |
| 3,383,718 | A * | 5/1968 | Spencer | 5/100 |
| 3,535,717 | A * | 10/1970 | Mulder | 5/93.1 |
| 3,563,599 | A * | 2/1971 | Heumann | 297/218.5 |
| 3,979,783 | A | 9/1976 | Spencer | |
| 5,038,427 | A | 8/1991 | Golden | |
| 5,173,974 | A * | 12/1992 | Proano et al. | 5/93.2 |
| 5,715,551 | A * | 2/1998 | Proano et al. | 5/93.2 |
| 6,564,403 | B1 | 5/2003 | Titus | |
| 6,658,677 | B2 * | 12/2003 | Paul | 5/280 |
| 7,712,162 | B2 * | 5/2010 | Shamie et al. | 5/2.1 |
| 2003/0061654 | A1 | 4/2003 | Lenner | |
| 2004/0205892 | A1 | 10/2004 | Raphael-Davis et al. | |
| 2005/0229306 | A1 | 10/2005 | Briere | |

FOREIGN PATENT DOCUMENTS

DE 9200592 U1 3/1992

(Continued)

*Primary Examiner* — Michael Trettel

(74) *Attorney, Agent, or Firm* — Hultquist, PLLC; Frank J. Bozzo; Steven J. Hultquist

(57) ABSTRACT

A sleeping unit or apparatus which is convertible between a low and high cot, toddler bed, a bed and/or a sofa, which sleeping unit comprises one or more walls, said one or more walls comprising one or more upholstered protective panels. Also provided is a sleeping unit or apparatus which is convertible between a low and high cot, toddler bed, a bed and/or a sofa, into which one or more upholstered protective panels may be incorporated, an apparatus for reversibly attaching an upholstered panel to a solid wall of a sleeping unit and a sleeping unit comprising such a reversibly attachable upholstered protective panel.

20 Claims, 13 Drawing Sheets

FOREIGN PATENT DOCUMENTS

| | | | |
|---|---|---|---|
| DE | 202006015026 | U1 | 1/2007 |
| FR | 1 370 117 | A | 8/1964 |
| FR | 2 601 572 | B1 | 1/1988 |
| GB | 563303 | A | 8/1944 |
| GB | 1 182 182 | A | 2/1970 |
| GB | 2 245 825 | A | 1/1992 |
| GB | 2 295 770 | A | 8/1996 |
| GB | 2 423 243 | A | 8/2006 |
| WO | 2004071245 | A1 | 8/2004 |

* cited by examiner

SLEEPING UNIT

CROSS-REFERENCE TO RELATED APPLICATIONS

This application is a U.S. national phase under the provisions of 35 U.S.C. §371 of International Application No. PCT/GB08/01408 filed Apr. 21, 2008, which in turn claims priority of each of United Kingdom Patent Application No. 0707581.5 filed Apr. 19, 2007, United Kingdom Patent Application No. 0713491.9 filed Jul. 12, 2007, United Kingdom Patent Application No. 0713493.5 filed Jul. 12, 2007, and United Kingdom Patent Application No. 0714423.1 filed Jul. 24, 2007. The disclosures of such international application and United Kingdom priority applications are hereby incorporated herein by reference in their respective entireties, for all purposes.

FIELD OF THE INVENTION

The present invention relates to an apparatus for sleeping on which may be convertible between a low and high cot, toddler bed, a bed and a sofa and which comprises one or more soft, upholstered protective panels.

BACKGROUND TO THE INVENTION

Many families use a separate cot, toddler bed and single bed as a baby grows into a toddler then a child or young adult, requiring multiple purchasing and either storage or disposal of the sleeping units as each becomes redundant. A single unit which could serve each of these functions would be advantageous.

When babies or small children move around in cots or cribs, they may come into contact with hard faces of the cot walls or bars, which may cause bruising or discomfort. Removable upholstered "bumpers" comprising upholstered foam panels with tie or Velcro connections are available, which are suitable for tying or sticking to cots with bars. However, the use of ties means that these bumpers are generally not suitable for attachment to cots with solid walls. Moreover, conventional cot bumpers are not suitable for babies once they can sit up as they allow the child to gain a foothold and climb out or become caught up in the bumper.

STATEMENTS OF THE INVENTION

According to the present invention, there is provided a sleeping unit or apparatus which is convertible between a low and high cot, toddler bed, a bed and/or a sofa, which sleeping unit comprises one or more walls, said one or more walls comprising one or more upholstered protective panels.

The invention further provides a sleeping unit or apparatus which is convertible between a low and high cot, toddler bed, a bed and/or a sofa, into which one or more upholstered protective panels may be incorporated.

Also provided is an apparatus for reversibly attaching to a solid wall of a sleeping unit, which comprises an upholstered panel and interlocking means, said interlocking means comprising first and second elements which reversibly interlock together, one of said first or said second elements being provided in said upholstered panel, and the other being integral with or fixable to a solid wall of a sleeping unit.

A sleeping unit comprising such a reversibly attachable apparatus is also provided.

DESCRIPTION OF THE INVENTION

As used herein the term "cot" shall be taken to mean a sleeping apparatus which has walls, bars or other restrictive means to prevent a baby or child getting out of their own accord.

As used herein the term "bed" shall be taken to mean a sleeping apparatus which has at least one open edge via which a user can enter and exit. A "toddler bed" is a shorter bed for small children, generally the same length as a cot.

As used herein the term "sofa" means a seating unit with a back support and suitable for one or more people, for example a seating unit that has an upholstered or cushioned seat.

A "sleeping unit" means a multifunctional sleeping unit which is interconvertible, for example, between a low or high cot (for use by younger and older babies respectively), a toddler bed, a bed and/or a sofa The upholstered protective panels for use according to the invention may take various forms but will generally comprise a pad of a resilient material such as latex or a resilient foam, for example a polymeric foam, or of wadding for example of a natural fabric such as wool, cotton or hemp. This is suitably covered with a stain resistant, wipe clean cover such as leather, plastic or upholstery fabric or a washable cover such as cotton, bamboo or polyester, which is fixed over the foam or wadding panel.

It will be appreciated that the one or more upholstered protective panels may be integrally formed on one or more walls of the sleeping unit or the one or more protective panels may be reversibly attached to one or more walls of the convertible sleeping unit.

Where the protective panel is integrally formed on the wall or walls of the sleeping unit, this may be achieved by conventional means such as stapling or affixing using adhesive where the method of fixing is not accessible to the infant or the child.

Reversible attachment of the protective panels is desirable to allow the possibility of changing the design, colour or appearance of the protective panel to suit the user's taste by fitting elasticated covers over the top of the wipe clean, hard-backed panel; or to facilitate washing of a soft backed panel.

A rigid or semi-rigid backboard, for example of a plastics material, intended to contact the sleeping unit wall may also be provided to support the foam or wadding in some embodiments of the panel, and also to provide a support for the first or second element of the interlocking means. However, in some instances, the panel may be completely soft and flexible, which may facilitate washing.

If desired a removable cover, for example of a washable fabric, may be provided so as to enclose the wipe clean panel. In particular, the removable cover may comprise an elasticated or zip fastening washable fabric cover, for example, organic cotton, may be secured over the panel. The removable covers can be changed to suit the individual child's or person's tastes.

Alternatively, the wall incorporating the protective panel may be detached from the sleeping unit, reversed and re-attached to the sleeping unit to give a choice of interior design to the user.

The panel may be of a size and shape so as to cover the entire sleeping unit wall or may cover just a region of the wall, which is likely to come into contact with the occupants body and in particular the head. They may be designed to form the entire interior and even the exterior walls of the sleeping unit if desired.

The interlocking means may take various forms also. Suitably the interlocking elements should be such that once interlocked, the panel is held firmly in position against the wall of the sleeping unit and cannot be removed by an infant or toddler.

In one embodiment, a first element of the interlocking means comprises one or more extrusions or studs which are fitted or fixable to the wall of the sleeping unit, or more preferably, to the panel, and in particular to a rigid or semi-rigid backboard in the panel and which are suitably of a resilient material such as a resilient polymeric material. In that case, the second element of the interlocking means is one or more appropriately shaped apertures in the other of the panel or the wall of the sleeping unit which are adapted to allow the extrusions to enter and be held therein.

For instance, the extrusion may comprise a section of generally conical shape, with a triangular cross section, arranged on a small projection which projects from a base of the triangular section, so effectively forming an "arrow head" shape. In this case, the aperture is shaped to accommodate at least the triangular section but where the internal diameter is larger in at least one dimension than the opening. In this embodiment, where the extrusion is of a resilient material, the interlocking means may be applied by pressing the triangular section against the opening of the aperture. The apex of the triangle enters the aperture first, and under pressure, the expanded base end becomes compressed and passes through the opening of the aperture. However, once inside the aperture, the compression pressure is released, so the base expands and abuts against the area surrounding the opening of the aperture, preventing the extrusion from leaving the aperture. Where the aperture is positioned in the wall of the cot, where the wall is of a hollow construction it will be apparent that no specific shaping of the aperture may be required, as the extrusion will abut against the inner surface of the hollow wall.

However, where the extrusions are not of resilient materials, "twist lock" arrangements, whereby the opening of the aperture is shaped to allow the extrusion to pass through in one orientation, but not in another, might be used.

In order to remove the panel from the wall, a suitable deforming tool may be applied to the projection which remains outside the aperture, in order to cause the resilience of the extrusion to allow removal, or to twist the projection so that it becomes aligned with a wider region of the opening of the aperture.

Preferably, in this case, a series of interlocking extrusions and apertures are provided and distributed over at least a substantial portion and preferably all of the panel area, so that a good fixing is achieved. However, if desired the first and second interlocking elements may be applied just to edge regions of the panels.

Such interlocking elements are known for fixing of panels in cars, but have not hitherto been used in the context of cots and cribs. An apparatus for reversibly attaching to a solid wall of a cot, crib or bed which comprises an upholstered panel and interlocking means, said interlocking means comprising first and second elements which reversibly interlock together, one of said first or said second elements being provided in said upholstered panel, and the other being integral with or fixable to a solid wall of a cot, crib or bed is therefore novel and provides a further aspect of the invention.

In an alternative embodiment, the first element of the interlocking means comprises a rigid runner and the second element comprises a guide rail, adapted to hold the runner. The runner may be slid into position in the guide rail. Suitably, runners or guide rails are provided in the side regions of each of the panel or the wall and cannot be removed by an infant or toddler.

In yet another embodiment, the panel is fixed only at a top region thereof, so that effectively "hangs" in position. In such instances, the interlocking elements may comprise conventional fixing means such as hooks and eye, or fasteners including screw fasteners or locks may be used as the interlocking means.

Preferably however, in such cases, some means of fixing the panel to the wall of the cot is also provided at the lower region of the panel.

Indeed, screw fixing or locks may be used in any of the embodiments of the invention. Where the panels are entirely soft, they may suitably be held in position by means of press studs, provided that a suitable element of the stud may be incorporated into the wall of the cot. Commercially available press studs specifically intended for use with wood may suitably be used.

The panels may be used in any cot, crib or bed but in particular, will be used in cots, toddler beds or cribs.

Panels may be provided in all the walls of the cot or in particular walls only such as the head and/or side walls, which are more likely to be collided with by a baby or child. They may in some instances, constitute all the interior and exterior walls of the cot or crib, including the side walls which may have upholstered bars. Where used in a bed, they may be confined to a head and/or foot board, and in particular a headboard. In particular, they may be used in toddler beds on the side barriers as well as the headboard and footboard.

Panels of this type may be used in a wide variety of beds, cots and cribs, and beds, cots or cribs comprising these form a further aspect of the invention.

In particular, the first or second element of the interlocking means is integral with the wall of the cot, crib or bed, so as to provide a secure attachment.

In particular, the removeable nature means that they are particularly suitable for use in sleeping units which fulfil multiple functions.

In one aspect, a sleeping unit or apparatus which may be convertible between a low and high cot, toddler bed, a bed and a sofa and which comprises one or more upholstered protective panels comprises:— a base with a mattress support means;

at least two opposed lateral walls extending upwardly from the base, each of which walls are optionally removable;

and two end walls located between the lateral walls, a first end wall which is padded and optionally removable, and a second optionally removable end wall, and in which the base and/or each or both of the lateral walls optionally include a storage compartment and/or a desk unit.

It will be appreciated that the "opposed lateral walls" constitute the headboard and footboard walls when the sleeping unit or apparatus is in the cot configuration with the "end walls" constituting the side walls of the cot.

The first and second end walls are optionally removable but preferably the first padded end wall is fixed in position and the second end wall is removable.

The second end wall of the furniture unit may engage with a retraction means which allows the end wall to be reversibly retracted into the base (for example, retracted to a position below or into the mattress support means). The retraction may be operable single-handedly.

The end wall or walls may alternatively be removed via a substantially vertical drop mechanism, preferably operable single-handedly.

The first and second end walls may be removable by different mechanisms, for example one of the end walls via the retraction means and the other via the substantially vertical drop mechanism.

The first end wall is permanently padded but the remaining walls of this sleeping unit may be permanently upholstered with padding or may suitably be provided with hinged upholstered panels or with reversibly attachable upholstered protective panels according to the aspect above.

In an embodiment the unit may further comprise a bag or other suitable container which is preferably appropriate for storing one or more of the components of the apparatus.

In another aspect, the invention provides a sleeping unit or apparatus which may be convertible between a low and high cot, toddler bed, a bed and/or a sofa, comprising:— an invertible and extendible base;

a headboard and a footboard (or baseboard), each insertable into the base; and optionally one or two lateral side walls positionable or positioned between the headboard and the footboard and which are optionally removable (by detaching or lowering, for example), and in which the base comprises a first receiving means to hold an inserted headboard and/or footboard at a first level when the base is in a first orientation, and a second receiving means to position an inserted headboard and/or footboard at a raised level compared with the first level when the base is inverted with respect to the first orientation.

This interconvertible sleeping unit utilises the bed base as a conversion tool. This advantageously allows the same sleeping unit to be used by a person of all ages.

In a particular embodiment when this sleeping unit is in its highest cot configuration it may comprise two base supports or "bricks" with extensions formed by extensions built in to the bricks, a cot headboard (preferably curved, or with curved edges) and a cot footboard (preferably curved, or with curved edges), and one or two framed and netted panels which comprise the two lateral cot walls. In an embodiment one or both of the side walls (or netted panels) may be lowered to gain easier access to the baby. In the lowest position, the side walls (or netted panel(s)) allow space for an adult's feet to be positioned underneath the panel for correct positioning when reaching the baby. The side walls or netting may be of any desired shape, for example square, rectangular or triangular and may include more than one shape.

When the embodiment is in its highest cot configuration, the side walls comprising the headboard and footboard may rest within a shallow groove in the base bricks and may be fixed onto the base bricks for stability.

One or both of the lateral side walls may engage with a retraction means which allows the side wall to be reversibly retracted into the base. The retraction may be operable single-handedly.

The side walls may alternatively and preferably be removed via a substantially vertical drop mechanism, preferably operable single-handedly.

The side walls may be removable by different mechanisms, for example one of the side walls via the reaction means and the other via the substantially vertical drop mechanism.

In an embodiment, the headboard and footboard may be joined on in one piece with a side wall. This will leave one lateral side available for optional attachment of a side wall (for example, a netted side wall).

One side wall, for example a side wall joined in one piece with the headboard and footboard, may be of sufficient strength to act as a back support. This configuration also allows the embodiment to be utilised as a seating unit (also referred to herein as a "sofa"). A removable cover is optionally provided for the mattress.

In a particular embodiment one or both side (for example, framed and/or netted) walls may be removable, where the vertical framework disconnects. This may advantageously allow the wall or walls to be rolled and stored compactly.

In an embodiment the entire cot configuration may be lowered into and within the base, to form a cot or bed with lower surrounding panels. This is achievable by upturning the base bricks to gain access to a deep ridge within which slide the panels. This is advantageously suitable for a very young baby. When one or both wall panels are removed, the cot becomes a short bed or toddler bed suitable for young children who can independently enter and exit the bed.

In an embodiment the base bricks may be pulled apart from their original position and the mattress base may be placed onto the lower step of the base bricks. The system locks into place whereby the bricks are unable to move outwards beyond a certain distance. This advantageously allows the unit to be used by older children and adults as a full length single bed, whereby a mattress extension is added.

In an embodiment, the mattress base may comprise one or more bars or straps, for example, fabric straps or wooden bars. Advantageously such a base may provide a comfortable support for a mattress which the apparatus may further comprise.

In an embodiment, the base bricks may have protruding extensions which provide support to the mattress base. These extensions lock together at one length to prevent the embodiment from extending unintentionally. These extensions may contain an additional extension piece within, which locks into place when the unit is extended to single bed position.

In this particular embodiment, all external corners and edges are soft and curved. Advantageously, this may cause less damage to limbs as a result of contact with the corners and edges.

In an embodiment the unit may further comprise a bag or other suitable container which is preferably appropriate for storing one or more of the components of the apparatus.

The sleeping unit may be mounted on wheels, for example detachable or retractable or lockable wheels, optionally mounted to the base. The wheels will allow the unit to be moved more easily.

In another aspect of the invention there is provided an interconvertible sleeping unit as described above which is partially or fully upholstered, for example with wipe-clean upholstery and/or with removable panels as described above.

In a particular embodiment, the headboard and footboard (each optionally curved or with curved edges) and side walls may contain soft, padded panels. These panels may be upholstered with, for example, fabric or leather and are permanently fixed onto the inside and/or outside of the cot. Alternatively, the padded panels may be removable, whereby an elasticated or zip fastening washable fabric cover, for example, organic cotton, may be secured over the panel. Advantageously such a panel provides comfort for the individual within the embodiment and prevents damage to limbs. Additionally and advantageously, the removable covers can be changed to suit the individual child's tastes.

Most parents currently use a traditional cot with wooden bars for their young babies which can lead to limbs being knocked and becoming caught between the bars. A convertible apparatus that contains no such external bars or hard faces but, instead, comprises upholstered panels could be used to provide a higher level of safety and comfort for children and is therefore an advantage.

In a further aspect, another sleeping unit or apparatus into which one or more upholstered protective panels may be incorporated is a sleeping unit which is convertible between a cot and a bed, comprising:— a base;

two cot side walls, the side walls being removable;

a cot headboard; and a cot baseboard, wherein the cot headboard and/or the cot baseboard is formed in at least two parts, at least one of the parts of the cot headboard and/or baseboard being removable and attachable to the base in place of the cot side wall to form bed side barriers.

In one embodiment of the apparatus according to this aspect, both the cot headboard and the cot baseboard may be formed in at least two parts.

The two cot side walls are removable, allowing the cot to be converted into a bed and/or allow access to, or for a person using the cot.

In a particular embodiment the cot headboard (or baseboard) may be in two parts. In this embodiment one or both, for example both of the parts may be removable.

In an embodiment the removed cot headboard (or baseboard) or one or more removable parts thereof may be attachable to the base in place of the cot side walls to form one or more bed side-barriers.

In an embodiment the cot headboard may be in two parts both of which may be removable and attachable to the base in place of the cot side walls to form a pair of bed side-barriers.

In this embodiment the cot baseboard or a part thereof may be removable and may be attachable to the base in place of a removed cot headboard or part thereof to form a bed headboard.

In a particular embodiment the cot baseboard may be formed in two parts. In this embodiment one or both, for example both of the parts may be removable. In an embodiment the removed cot baseboard or one or more removable parts thereof may be attachable to the base in place of the cot side walls to form one or more bed side-barriers. In a particular embodiment the cot baseboard may be in two parts both of which may be removable and attachable to the base in place of the cot side walls to form a pair of bed side-barriers.

In this embodiment the cot headboard or a part thereof may be removable and may be attachable to the base in place of a removed cot baseboard or part thereof to form a bed baseboard. Suitably the cot headboard comprises two parts, a top part which may become the toddler bed headboard when the cot is converted to a bed and a bottom part which may be removed and attached to the base in place of the cot baseboard to form the toddler bed baseboard. Alternatively, the top part of the cot headboard may be removed and attached to the base in place of the removed baseboards to form a new cot headboard and the lower part of the cot headboard can be left in place to form the toddler bed baseboard when the cot is converted to a bed.

One of the bed side-barriers may be the same length or shorter than the side edges of the base. In an embodiment the bed side-barriers when in position may extend along a portion of the length of the base. In an embodiment the bed side-barriers extend from the headboard end towards the baseboard end. For example the bed side-barriers may be around at least half of the length of the base. Such bed side-barriers may advantageously protect a child from falling from the bed during the night but allow for easy access at the part where the bed side barriers do not extend to. Typically, the side barriers are around two thirds of the length of the toddler bed.

It will be appreciated that one side wall of the cot or crib may be removed entirely and the cot positioned next to an adult to allow ease of access for the parent to the young baby during the night.

In an embodiment the base may be height adjustable. This advantageously may allow the base to be raised to a raised position for the use of an infant and then lowered, as the infant gets older. In an embodiment the apparatus may further comprise an external safety bar. Such a safety bar may be useful for securing the base through for example the side walls of the cot such that a child can not slip past the base when in a raised position.

In another embodiment one or more of the base, cot side walls, cot headboard, cot baseboard and therefore the bed side-barriers, the bed headboard and the bed baseboard may be formed from a soft material and/or may be at least partially padded.

In one embodiment, the cot has fixed wipe clean upholstery, for example leather, which may be covered with a cover, allowing older children to choose a colour or pattern and so individualize their beds.

Alternatively, the interior of the cot may be provided with protective upholstered panels as described above. These may be fixed, upholstered wipe clean panels which may comprise leather, vinyl or upholstery fabric material, for example, or they may be removable, wadded, washable panels which are reversibly attachable to the inner wall or walls of the cot by the methods described above, for example by means of press studs. The inner wall may suitably comprise a solid wood panel or a wood panel containing a matrix of holes for added air circulation. Alternatively, the inner wall may comprise plastics material or a resilient wire mesh. In the case of a soft wall, additional velcro fastenings may additionally be employed to ensure security of fastening.

Particular methods for attaching the upholstered panels to the walls of the cot include using a Lego™ type board as the rigid backing to upholstered panels. The inner wall of the cot/bed would also be of a board of this type such that the two boards fit together and require a "key" to remove them. The exterior walls/ends of the cot/bed may also comprise such boards, providing a play area for the children on the outer cot walls.

Hard backed, wipe-clean upholstered panels may also be attached through holes in the solid inner walls of the cot by means of a nut and bolt type attachment. These panels can also be removed in order to slip elasticated, washable e.g. cotton or polyester covers of various designs over them for individuality. These upholstered panels may take up the whole face of the wall or just parts of the wall.

In an embodiment one or more of the base, cot side walls, cot headboard, cot baseboard and therefore the bed side-barriers, the bed headboard and the bed baseboard may comprise one or more viewing window(s). A viewing window may comprise a mesh or netting window, for example polyester. The window(s) may be of any desired shape, for example square, circular or triangular. Preferably the netting may be fire-retardant and/or wipe-clean and/or hypo-allergenic.

In an embodiment one or more of the base, cot side walls, cot headboard, cot baseboard and therefore the bed side-barriers, the bed headboard and the bed baseboard may be formed from fabric arranged on a frame, for example a metal or wood frame, and the frame may optionally covered with a protective sleeve.

In a particular embodiment, however, the framework of the cot comprises wood. The cot side walls preferably comprise wadded fabric, for example marino wool wadding with a cotton outer cover, and comprise at least one netted region to allow for air circulation and easy viewing of the child in the cot.

These wadded walls may be attached to a rigid wall as mentioned above or contain no rigid inner wall, instead being suspended taughtly by loops (for example, of lycra or other such material) fed through the centre of the wooden framework structure and held in place by a wooden strip which slides through the loops. Alternatively, this wadded cotton wall with netted ellipse may attach over the side framework with strong fabric to fabric press studs, attaching on the exterior of the cot.

In an embodiment the base may comprise one or more bars or straps, for example rubber or fabric straps associated with a supporting frame. One or more of these fabric straps may be strong and/or flexible and/or elastic. Advantageously such a base may provide a comfortable support for a mattress which the apparatus may further comprise. Alternatively, the base may comprise wooded slats.

In an embodiment the apparatus may further comprise a base extension. This may advantageously allow the length of the apparatus to be increased which will therefore allow the apparatus to be used for a longer period of time as a child is growing up. The base extension may extend from the end of the bed remote from the headboard but in a particular embodiment the base comprises two parts joined together which may be separated and a base extension part inserted within the run of the base, the original parts of the base being rejoined to either side of the extension part. Any conventional method for joining the base parts and insert may be used. Suitably the base parts and insert are shaped so as to interlock each other, for example, the insert portion may have a "butterfly" shaped cross-section with projections projecting from either side which interlock with appropriately shaped grooves in the corresponding base parts. A mattress extension piece may then be added.

The cot or bed may suitably be provided with attachments which are preferably padded and may be detachably or permanently secured to the cot or bed to improve its aesthetic appearance. For example, the cot or bed may be provided with attachments such that it has the appearance of a train, racing car or castle.

In an embodiment the apparatus may further comprise a bag or other suitable container which is preferably suitable for storing one or more of the components of the apparatus, for example all of the components.

Throughout the description and claims of this specification, the words "comprise" and "contain" and variations of the words, for example "comprising" and "comprises", mean "including but not limited to", and do not exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Other features of the present invention will become apparent from the following example. Generally speaking the invention extends to any novel one, or any novel combination, of the features disclosed in this specification (including any accompanying claims and drawings). Thus features, integers or characteristics described in conjunction with a particular aspect, embodiment or example of the invention are to be understood to be applicable to any other aspect, embodiment or example described herein unless incompatible therewith.

Moreover unless stated otherwise, any feature disclosed herein may be replaced by an alternative feature serving the same or a similar purpose.

The present invention will now be described by way of example only and with reference to the accompanying illustrative drawings which are schematic.

FIG. 7 (*b*) shows an exploded view of the base bricks and mattress base, extending from toddler bed to single bed positions.

Figure 1:
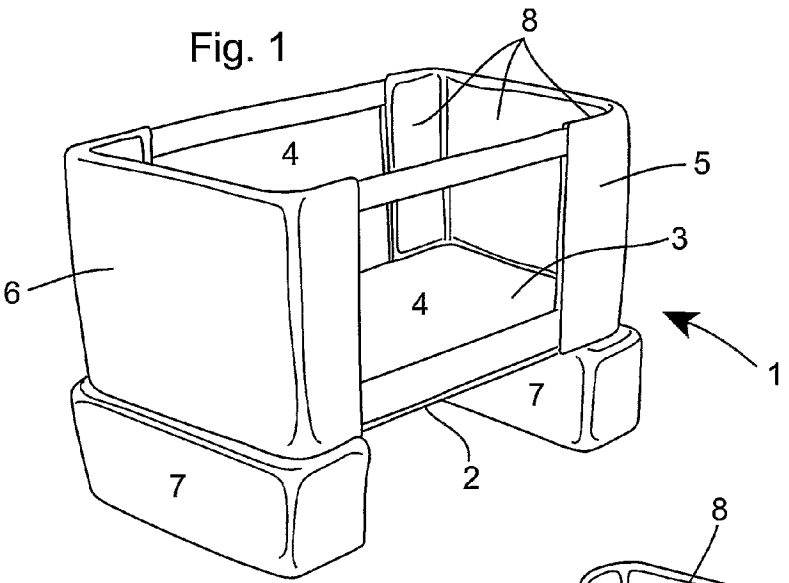
FIG. 1 shows a perspective view of an embodiment of a cot configuration for an older baby comprising panels of the invention.
Figure 4:
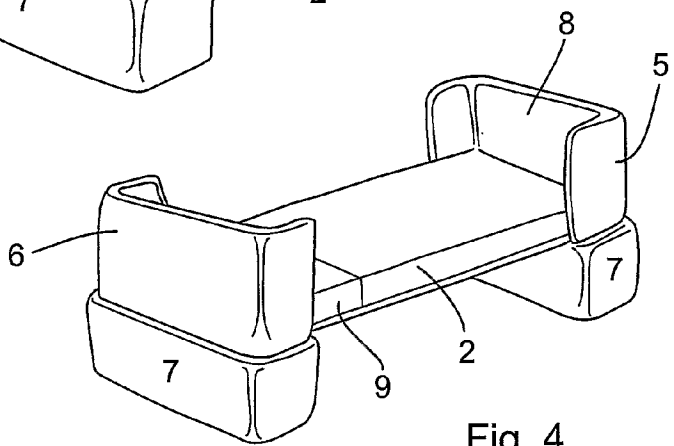
FIG. 4 shows a perspective view of an embodiment of the present invention in the extended single bed configuration for an older child or adult (i.e. taller than a toddler).
Figure 7A:
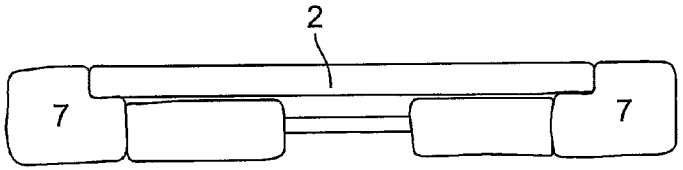
FIG. 7 (*a*) shows a side view of the base bricks in extended single bed position with the mattress base on the lower step.
Figure 8:
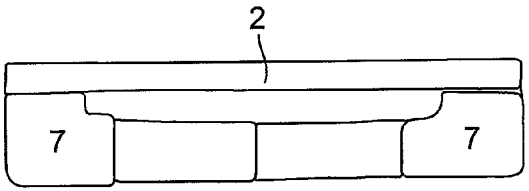
FIG. 8 shows a side view of the base bricks in toddler bed position with the mattress base at the highest point.
Figure 7B:
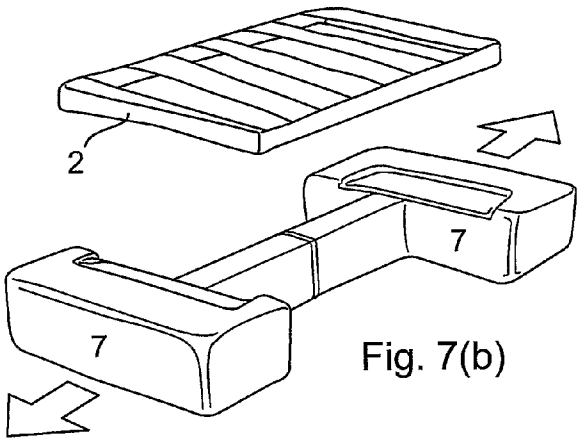
Figure 5:
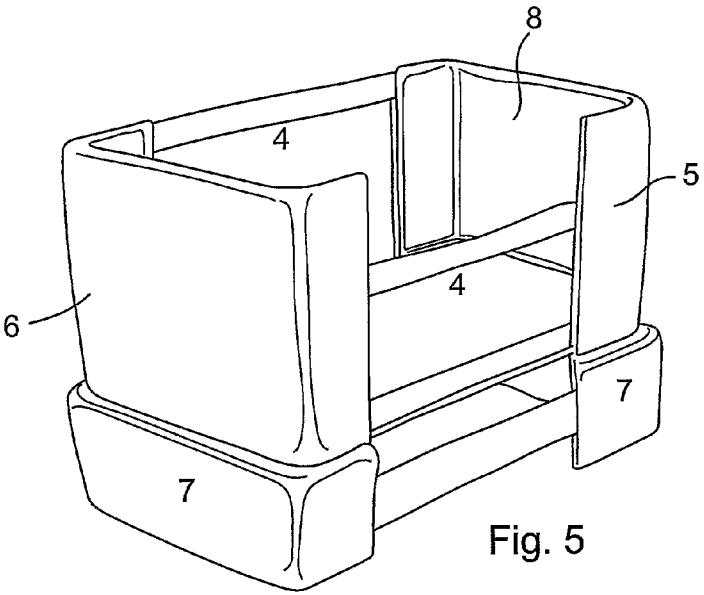
FIG. 5 shows a perspective view of an embodiment of the present invention in the cot configuration for an older baby, with the one-handed drop side in a lowered position.
Figure 6:
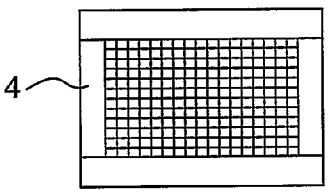
FIG. 6 shows a perspective view of one side of the cot; a wooden framework containing taught netting.

It can be seen in FIG. 1 that when the sleeping unit or apparatus (indicated generally at 1) is in its cot configuration for an older baby, it comprises a base 2 on which a mattress 3 can be placed. The apparatus 1 also comprises cot side walls 4 (one of which is a one-handed drop side wall), a curved cot headboard 5 and a curved cot footboard 6. The cot headboard and cot footboard are identical and each comprises three upholstered panels 8, which can be removed to change the washable covers. In addition the apparatus further comprises a pair of base blocks 7. The apparatus mainly comprises wood, for example maple or beech. This wood may or may not be laminated. Alternatively, the main material could be plastic or rattan.

In an embodiment the cot side walls 4 are removable to form a bed without sides for a toddler and older child or adult. The vertical struts or poles can be detached and the walls may therefore be rolled for storage.

Figure 2:
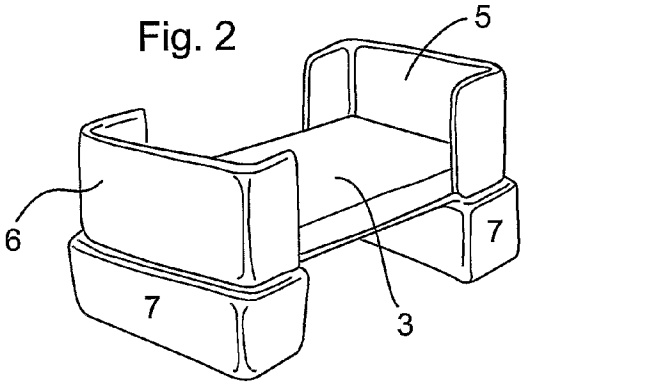
FIG. 2 shows a perspective view of an embodiment of the present invention in the toddler bed configuration.

As can be seen in the bed embodiment shown in FIG. 2 the headboard 5 and footboard 6 are height adjustable and have been lowered into the base blocks 7 to form a toddler bed.

This apparatus therefore advantageously allows the cot to be converted into a toddler bed and the toddler bed to be converted into a cot.

In an alternative choice of embodiment, one or more or all of the cot headboard 5, cot footboard 6, framework holding the netted walls and the netting 4 and even the base blocks may be at least partially upholstered or padded. For example, one or more may be formed from or comprise a soft fabric or leather or a foamed material or padding.

In an embodiment the framed and netted walls 4 may contain netting of any shape, for example a rectangle an ellipse or a triangle. The wooden panel at the top of the netted wall may have a Plastic teething rail fitted over it.

In a particular embodiment, the apparatus may alternatively be formed from fabric arranged on framework, for example steel or wooden framework. This fabric may or may not be padded, or contain netted windows.

Figure 3:
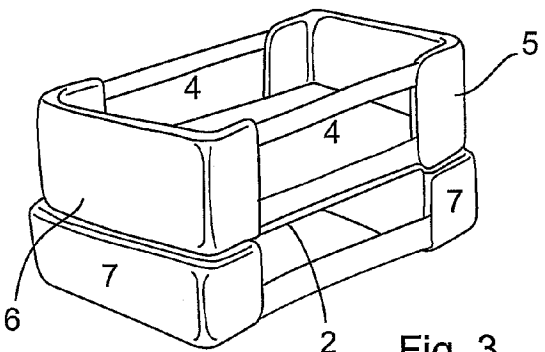
FIG. 3 shows a perspective view of an embodiment of the present invention in the cot configuration for a very young baby (i.e. before the baby can roll).

As can be seen in FIG. 3, the netted walls 4 can remain in the apparatus when the headboard 5 and footboard 6 are in the lower position within the base blocks 7. This advantageously allows a very young baby to lie safely within the apparatus and parents to easily reach their baby.

In an embodiment the base blocks 7 may be pulled apart, and lock into place, to create a bed of single bed length. A mattress extension piece 9 fits within the apparatus.

This advantageously enables the length of the apparatus to be increased which will therefore allow an older child or adult to comfortably use the bed.

In an alternative embodiment, the headboard 5 and footboard 6 may not contain upholstered panels and may 5 and 6 may be made from plain wood, plastic or rattan. Alternatively, one netted wall may be replaced with a wooden, plastic or rattan side wall which may optionally be upholstered.

The upholstered panels 8 may be removed at any point and the covers may be washed or even changed for a different design as the tastes of the child change. Alternatively, the covers may be removed permanently and the upholstered leather or fabric panels may be used without covers.

FIGS. 4 to 8 shows further embodiments of the invention.

Figure 9:
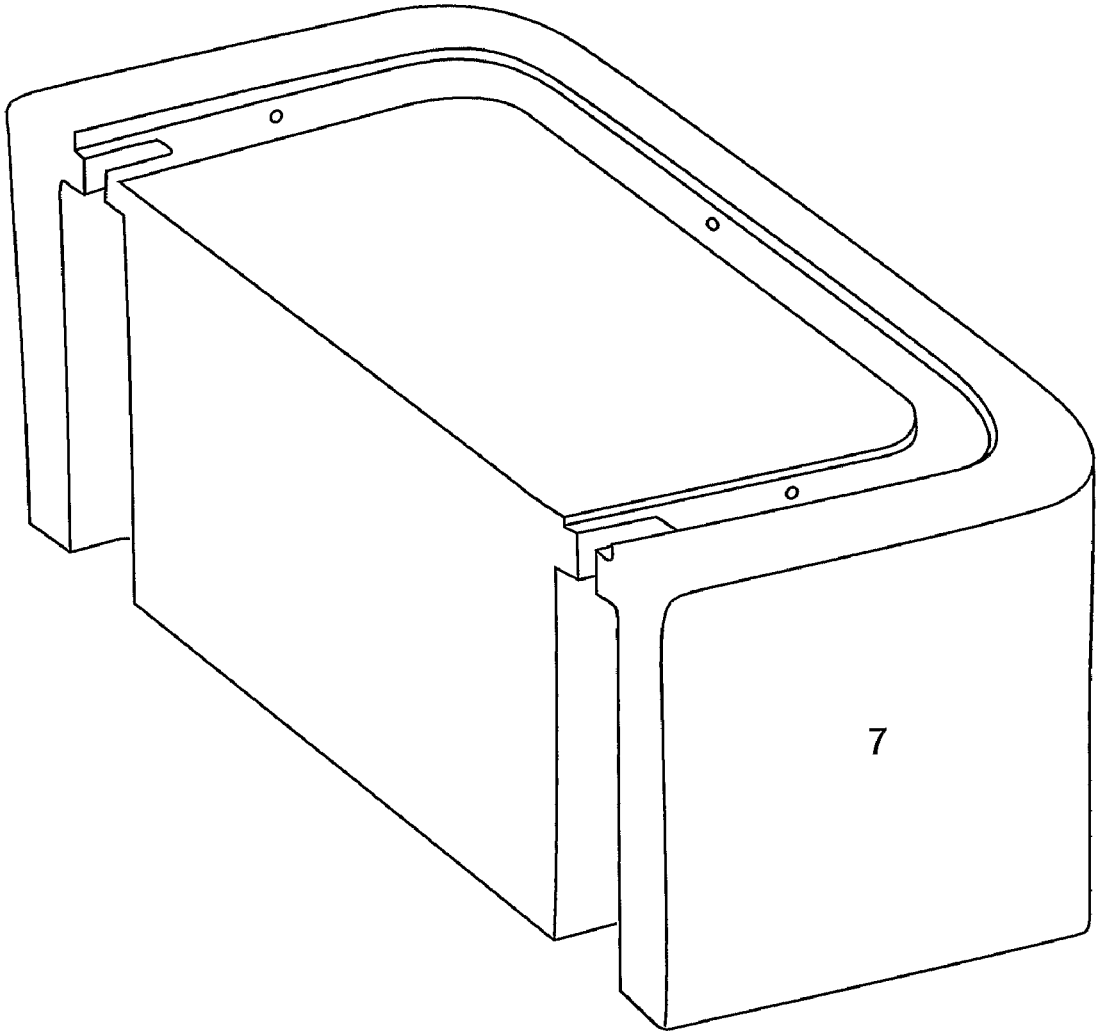
FIG. 9 shows a perspective view of a single base brick in the position to receive the apparatus in the cot position for the older child, as in FIG. 1.

FIG. 9 shows one of two identical base bricks or blocks. These blocks are invertible and each orientation is utilised for different functions. A first orientation in FIG. 9 allows the headboard 5 and footboard 6 and mattress base 2 to stand on top of the bricks and to be fixed for stability.

Figure 10:
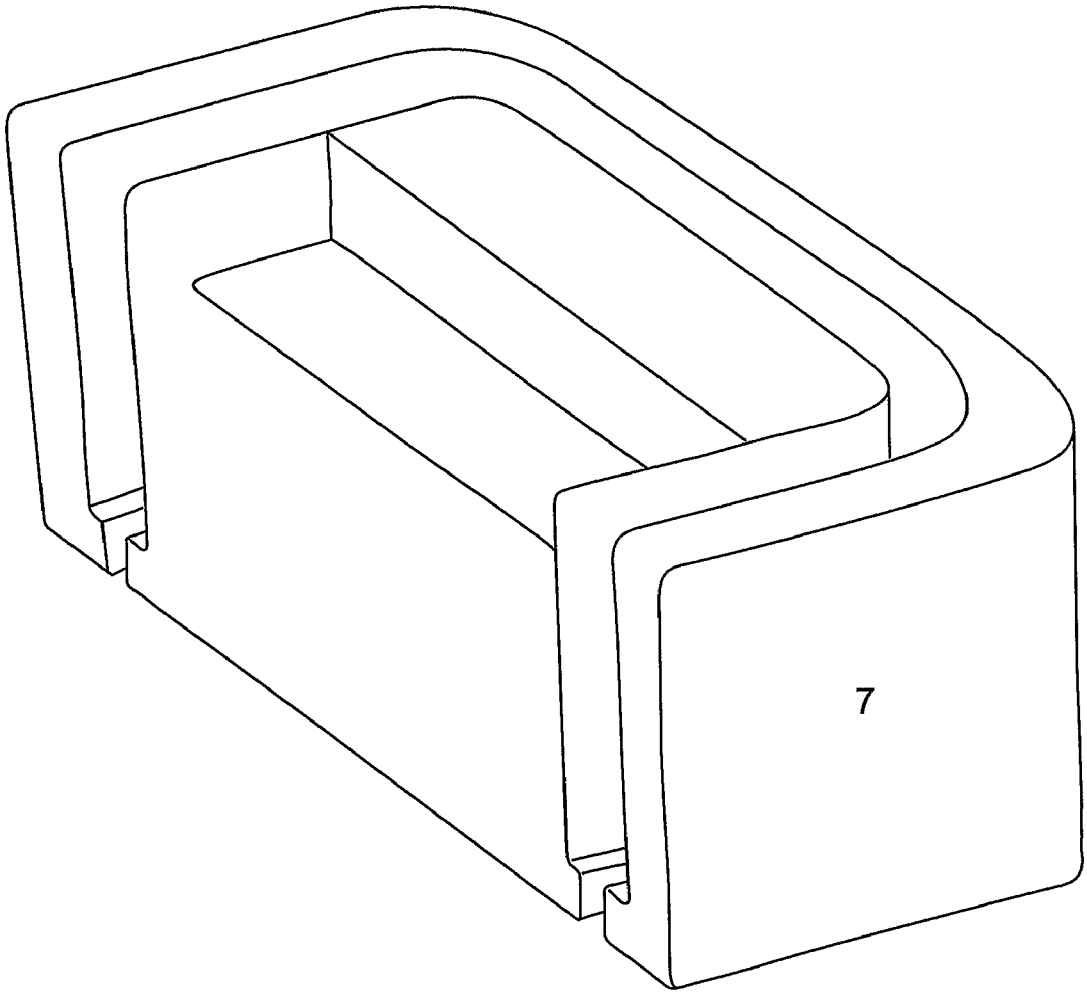
FIG. 10 shows a perspective view of a single base brick in the position to receive the apparatus in the cot position for a younger child, toddler bed and single bed positions (as shown in FIGS. 2, 3 and 4, respectively).

FIG. 10 shows an inverted orientation of a base brick or block. This orientation allows the headboard and footboard to be lowered down into the bricks, therefore lowering the overall height of the bed or cot walls.

Additionally, FIG. 10 shows a small step, the same height as the mattress base, which holds the mattress base. This increases the overall length of the bed and therefore allows a taller person to sleep on the apparatus.

In an embodiment, one of the framed and netted walls is a drop side. This drop side contains a one-handed mechanism. This advantageously allows the adult to continue holding the baby whilst lowering the side in order to lay the baby down.

Figure 11:
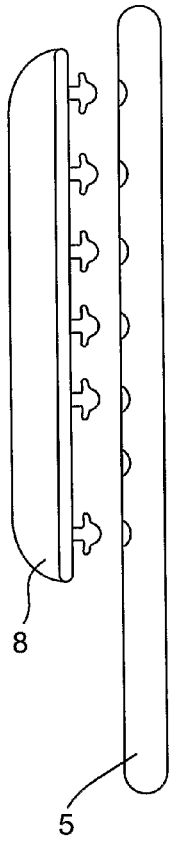
FIG. 11 shows a schematic view of how the upholstered panels may be fixed to and removed from the walls of an embodiment of the apparatus (similar to car panels). The extrusions may be within the upholstered panel, or within the cot headboard and footboard.
Figure 12:
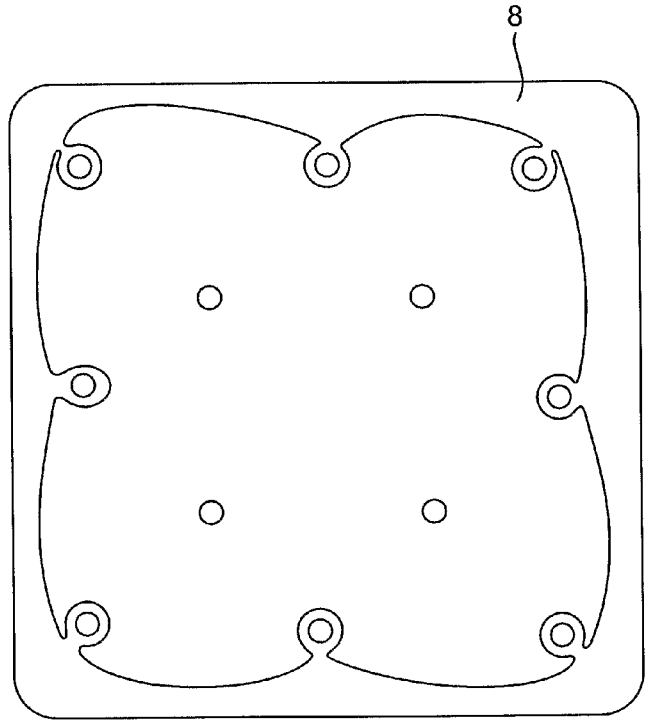
FIG. 12 shows the reverse side of an upholstered panel, with the elasticated, removable cover fastening onto the back of the panel.
Figure 13:
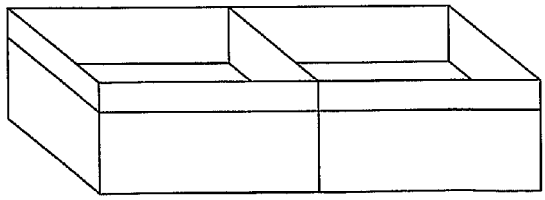
FIG. 13 shows two baskets or containers, made of wood or wicker, which can be slipped beneath the embodiment for storage. Up to four containers will be used.

FIG. 11 shows in more detail, a particular embodiment of the upholstered panel 8 which comprises a covered foam pad 9 supported on a rigid backboard 10. A series of resilient extrusion 11 extend out of the back of the board 10. Corresponding apertures 12 are provided in the wall 5 of the cot. These are shaped so that they can accommodate a portion 13 of the extrusion having a triangular cross section, in a manner such that the base of the triangle abuts against the inner surface of the wall 5. Thus the panel can be rigidly held against the wall 5.

Removal of the panel 8 from the wall 5 can be effected using a deforming tool (not shown) which may be applied to a projection 14 which extends out of the base of each triangular portion 13.

By making the panel removable, it may be used or not, depending upon the particular configuration of the sleeping apparatus.

Figure 14:
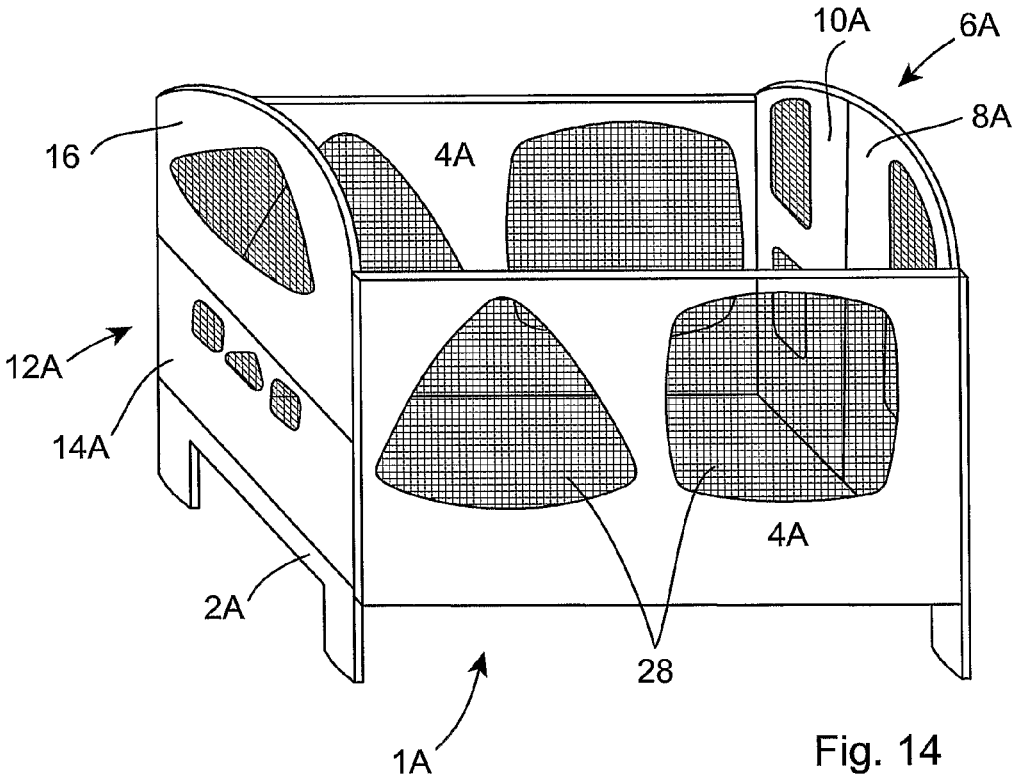
FIGS. 14 and 21 shows perspective views of embodiments of the present invention in a cot configuration.
Figures 21, 22, 23:
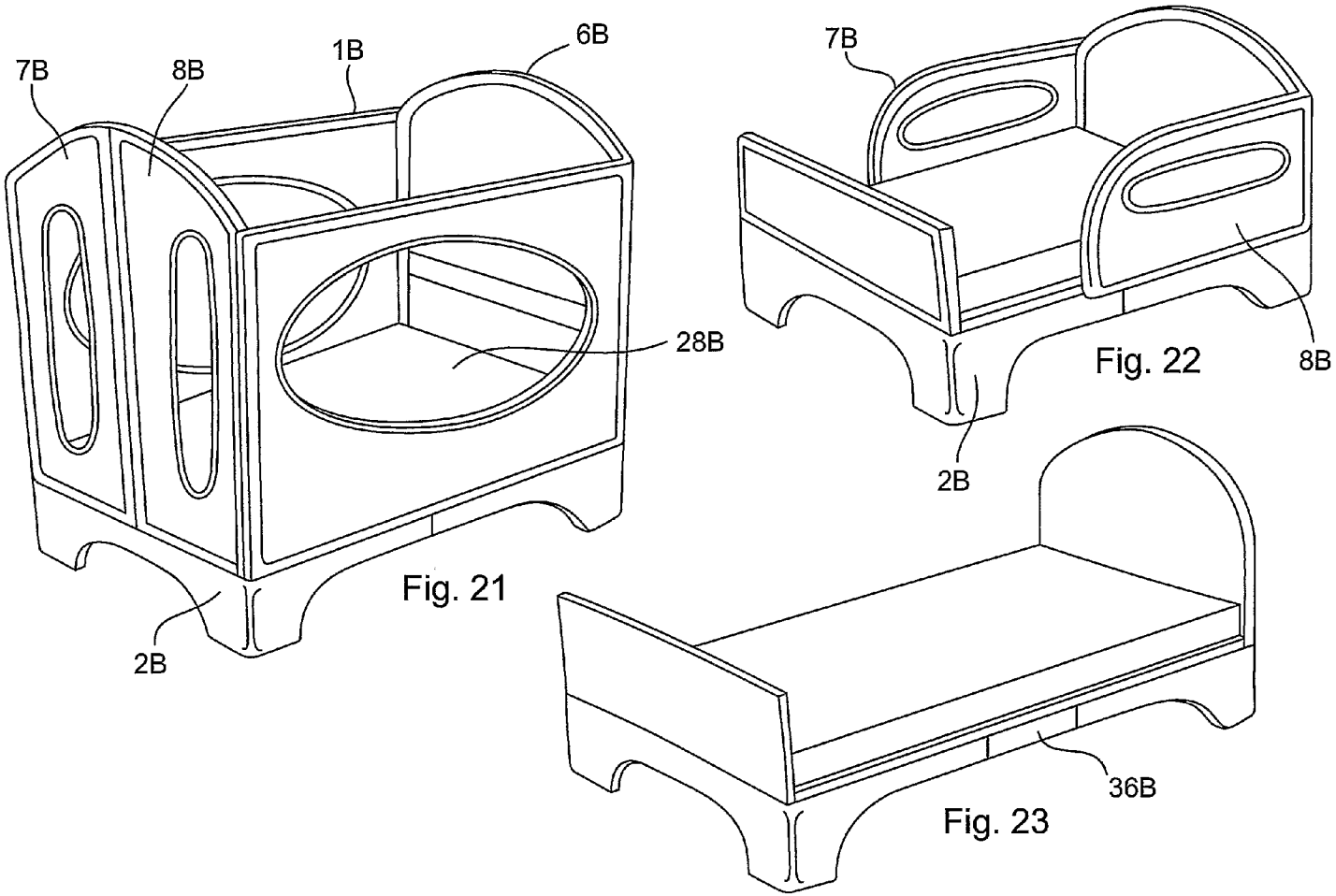
FIG. 23 shows an embodiment of the invention in the toddler bed configuration showing an extended base.

As can be seen in FIGS. 14 and 21 when the apparatus (indicated generally at 1A, 1B) is in it's cot configuration it comprises a base (2A, 2B) on which a mattress may be placed. The apparatus also comprises cot side walls 4A, 4B, a cot headboard (indicated generally at 6A, 6B) which in the embodiment of FIG. 14 is formed from a right part 8A and a left part 10A but in the preferred embodiment of FIG. 21 (see 6B) is formed of upper and lower parts. In FIG. 14, the apparatus further comprises a cot baseboard (indicated generally at 12A) formed from a lower part 14A and an upper part 16A. In the preferred embodiment of FIG. 21, the cot baseboard is formed from separate right and left parts (7B, 8B)

In the embodiments shown the cot side walls 4A, 4B are removable to form a bed.

Figure 15:
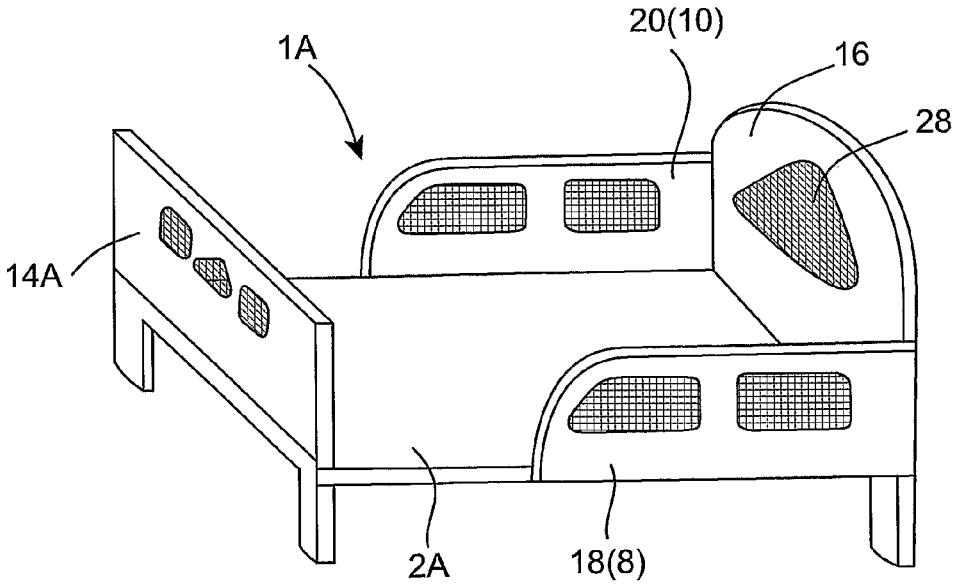
FIGS. 15 and 22 shows perspective views of an embodiment of the present invention in the bed configuration.

As can be seen in the bed embodiment shown in FIG. 15 the apparatus 1 preferably includes a pair of bed side-barriers 18 20. These bed side-barriers 18, 20 are actually the removed right and left headboard parts 8A, 10A respectively which have been removed and placed along the sides of the base 2A to form the bed side-barriers 18, 20.

In a preferred embodiment, FIG. 22, the pair of bed side barriers are the removed baseboards 7B, 8B which have been removed and placed along the sides of the base.

In the embodiment shown in FIG. 15 the upper part 16 of the cot baseboard 12 has been removed and placed at the opposite end of the base 2A to form a bed headboard 16. In FIG. 22, the cot headboard 6B has been disassembled with the upper part now forming the bed headboard and the lower part being removed and placed at the opposite end of the base to form the bed baseboard.

This apparatus therefore advantageously allows the cot to be converted into a bed and the bed to be converted into a cot.

In an embodiment the parts of the cot headboard 6A and/or cot baseboard 12A may be interchangeable. In an embodiment the parts of the bed headboard 16 and/or the bed baseboard 14A may be interchangeable. For example, as a child gets older it may be desirable to change the headboard 6A, 16 and/or baseboard 12A, 14A or a part thereof to one in a different colour, pattern or style. Preferably the components are made from fire-retardant and/or wipe-clean and/or hypoallergenic materials.

The bed side-barriers 18, 20 are preferably shorter than the side edges of the base 2. This can also be seen in the embodiment of FIG. 22 (see bed side barriers 7B and 8B). In the embodiment shown in FIG. 15 the bed side-barriers 18, 20 extend approximately half way along the length of the base 2.

In an embodiment the bed side-barriers 18, 20 extend from the bed headboard 16 end of the base 2 towards the bed baseboard 14 end. In the preferred embodiment of FIG. 22, the bed side barriers extend approximately two thirds along the length of the base 2B.

In the embodiment of FIG. 15 and FIG. 21 one or more of and preferably all of the cot side walls, the cot headboard, the cot baseboard and therefore also the bed side-barriers the bed baseboard and the bed headboard may be at least partially padded. For example one or more may be formed from or comprise a soft fabric and/or a foamed material.

In an embodiment the apparatus 1A or 1B may comprise one or more viewing window(s) 28, 28B. In the embodiments shown in FIGS. 14 to 16 it can be seen that the viewing windows 28 are formed from netting. The viewing windows 28B in the embodiment shown in FIG. 22 may also comprise netting (not shown) which preferably comprises polyester or a natural fibre.

The window(s) 28, 28B may be of any desired shape, for example square, circular or triangular. In the embodiments shown it can be seen that the viewing windows 28 may be below or above the height of the base 2A and/or a mattress 24 placed on the base. In the embodiments shown in FIGS. 14 and 15 they are above the base 2A and in the embodiment shown in FIG. 17 they are both above and below the base 2A. The netting is preferably highly visible and durable.

Figure 16:
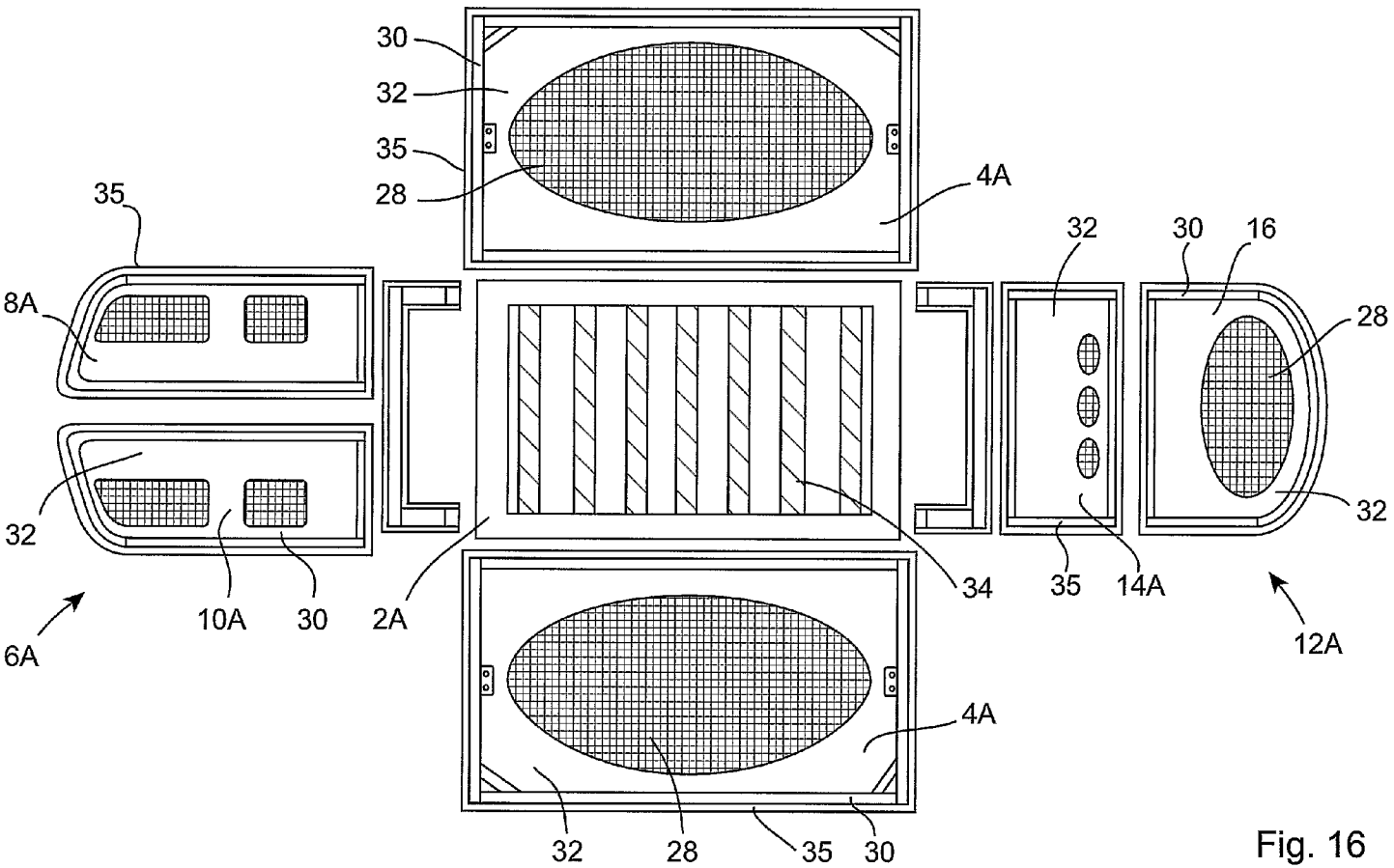
FIG. 16 shows an exploded view of an embodiment of the apparatus of FIG. 14.

In the embodiments shown in FIG. 16 one or more of the base 2A, the cot side walls 4A, the cot headboard 6A, the cot baseboard 12A and therefore the bed side-barriers 18, 20, the bed headboard 16 and the bed baseboard 14A are formed from fabric 32 arranged on a frame 30, for example a metal or wooden frame 30. In an embodiment the frame 30 may be formed from aluminium. The frame 30 may be at least partially covered with a protective sleeve 35 for example the frame 30 may be at least partially covered in a foamed material and/or a padded material. For example, the frame 30 may be covered with a sleeve 35 formed from polystyrene. Preferably the sleeve 35 is formed from a material which will hold it's shape over time.

In a preferred embodiment as shown in FIG. 21, the cot has an outer wooden frame which is visible around the upholstered protective panels when incorporated.

Figure 17:
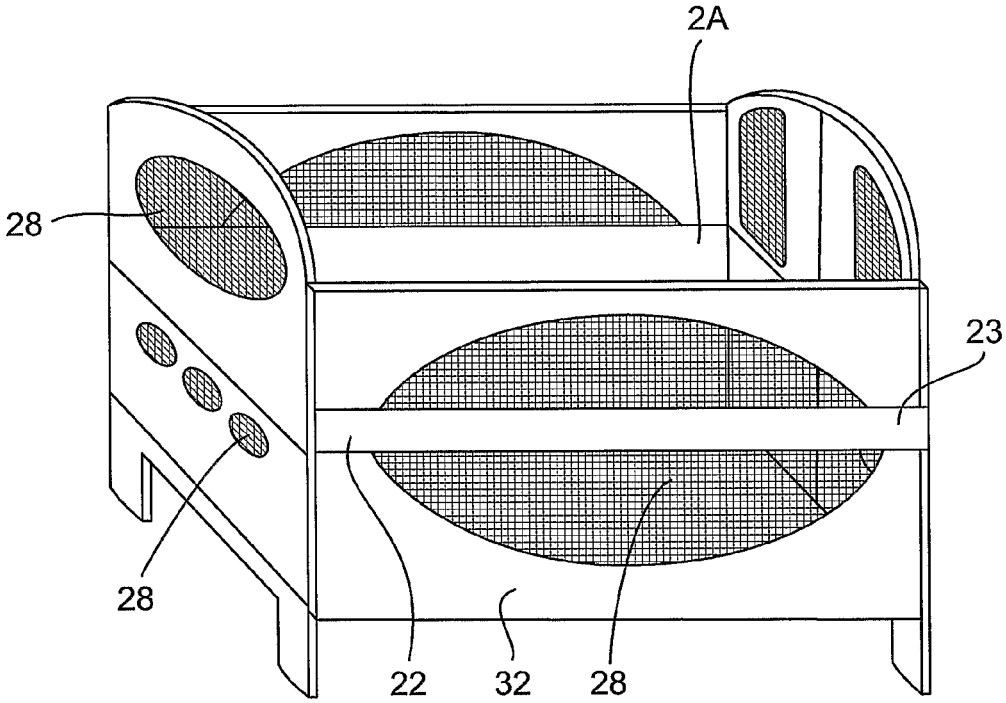
FIG. 17 shows a perspective view of an embodiment of the present invention in the cot configuration.

As can be seen in FIG. 17, the base 2A is preferably height adjustable. In FIG. 17 it can be seen that the height of the base 2A has been raised. This position may be more suitable for very young babies who cannot climb out. The base 2A can then be lowered as the child gets older.

In the embodiment shown in FIG. 17 the apparatus further comprises a pair of external safety bars 22 (only one visible). These safety bars 22 are useful for securing the base 2A through the side walls 4A of the cot such that a child cannot slip past the base 2A when the base 2A is in a raised position. This is particularly important when the cot side walls 4A are formed from fabric 32. In a preferred embodiment the safety bars 22 are positioned such that their top edges 23 are slightly above mattress 24 level. In a preferred embodiment the safety bars 22 may be padded and/or covered in a fabric or other material.

Figure 18:
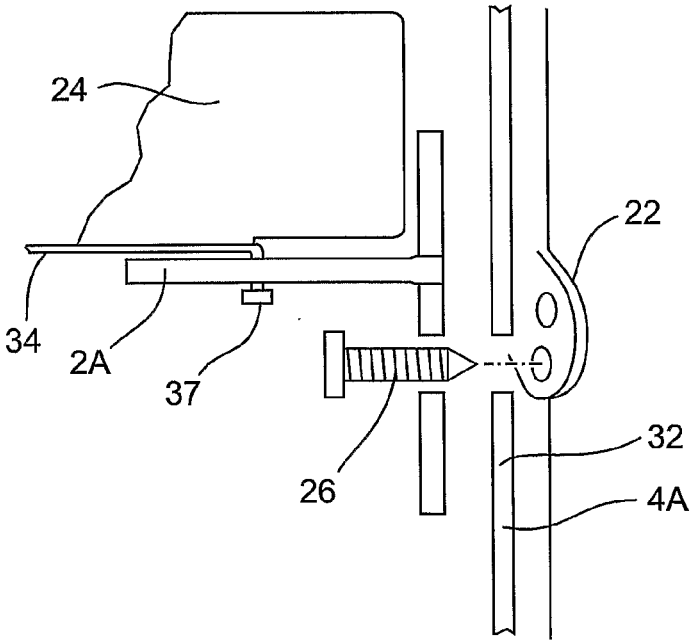
FIG. 18 shows a schematic view of how safety bars may be fixed to a base of an embodiment of the apparatus.

FIG. 18 shows how the safety bars 22 may be attached to the base 2A through the side walls 4A of the cot. A mattress 24 is positioned on top of the base 2A. A screw 26 or other attachment means is passed through the base 2A and cot side-walls 4A into the safety bar 22.

In an embodiment the base 2A may comprise one or more bars or straps 34, for example rubber or fabric straps 34 associated with the base 2. In a particular embodiment the straps 34 are fed through holes in the base 2. One or more of these fabric straps 34 may be strong and/or flexible and/or elastic. Advantageously this base 2A may provide a comfortable support for a mattress 24 which the apparatus 1 may further comprise. In the embodiment shown in FIG. 18 it can be seen that the straps 34 are attached to the base 2A by attachment means 37.

Figure 19:
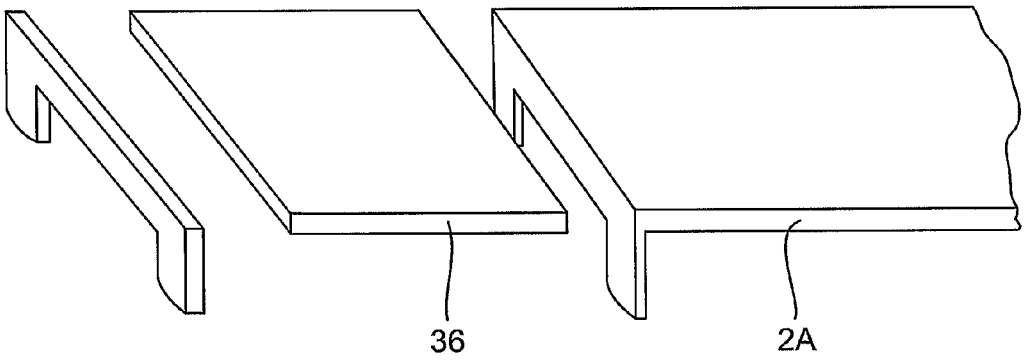
FIG. 19 shows an embodiment of the apparatus having a base extension.

In an embodiment the apparatus may further comprise a base extension 36 as shown in FIG. 19. This may advantageously allow the length of the apparatus 1 to be increased which will therefore allow it to be used for a longer period of time as a child is growing up. FIG. 23 shows an alternative preferred construction in which the length of the apparatus is increased by insertion of an extension piece 36B within the run of the base, the original parts of the base being rejoined to either side of the extension part rather than at the end of the base as in the embodiment of FIG. 19

Figure 20:
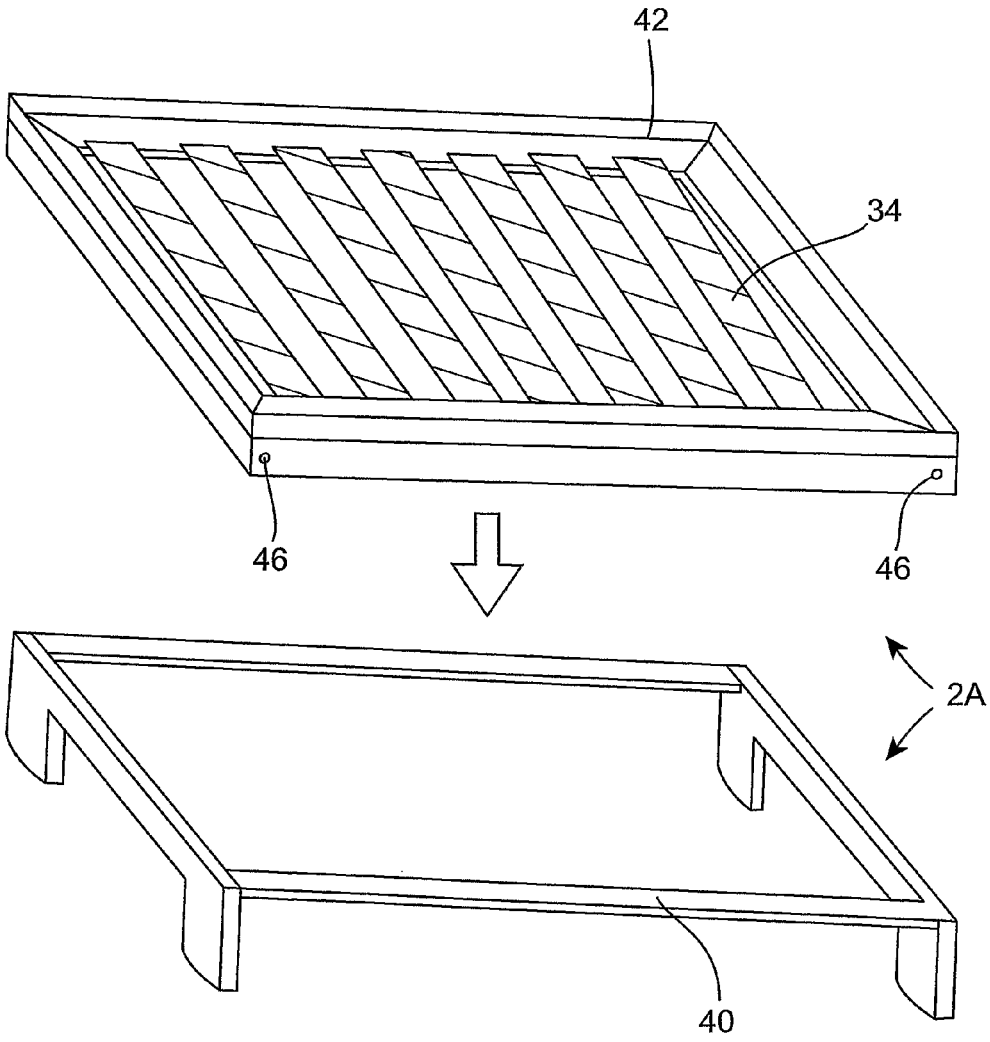
FIG. 20 shows an embodiment of the apparatus having a two-part base.

FIG. 20 shows an embodiment of the present invention where the base 2A is formed in two parts, namely a leg base 40 and a mattress base 42. In the embodiment shown the mattress base 42 fits snugly on and into the leg base 40 when the base 2A is in its lowest position. The leg base may be covered in rubber and/or a fabric to protect any exposed edges. The mattress base 42 has apertures 46 via which screws or any other suitable fixing means can be passed to attach the mattress base to the frame 30 and/or the external safety bars 22.

Figure 24:
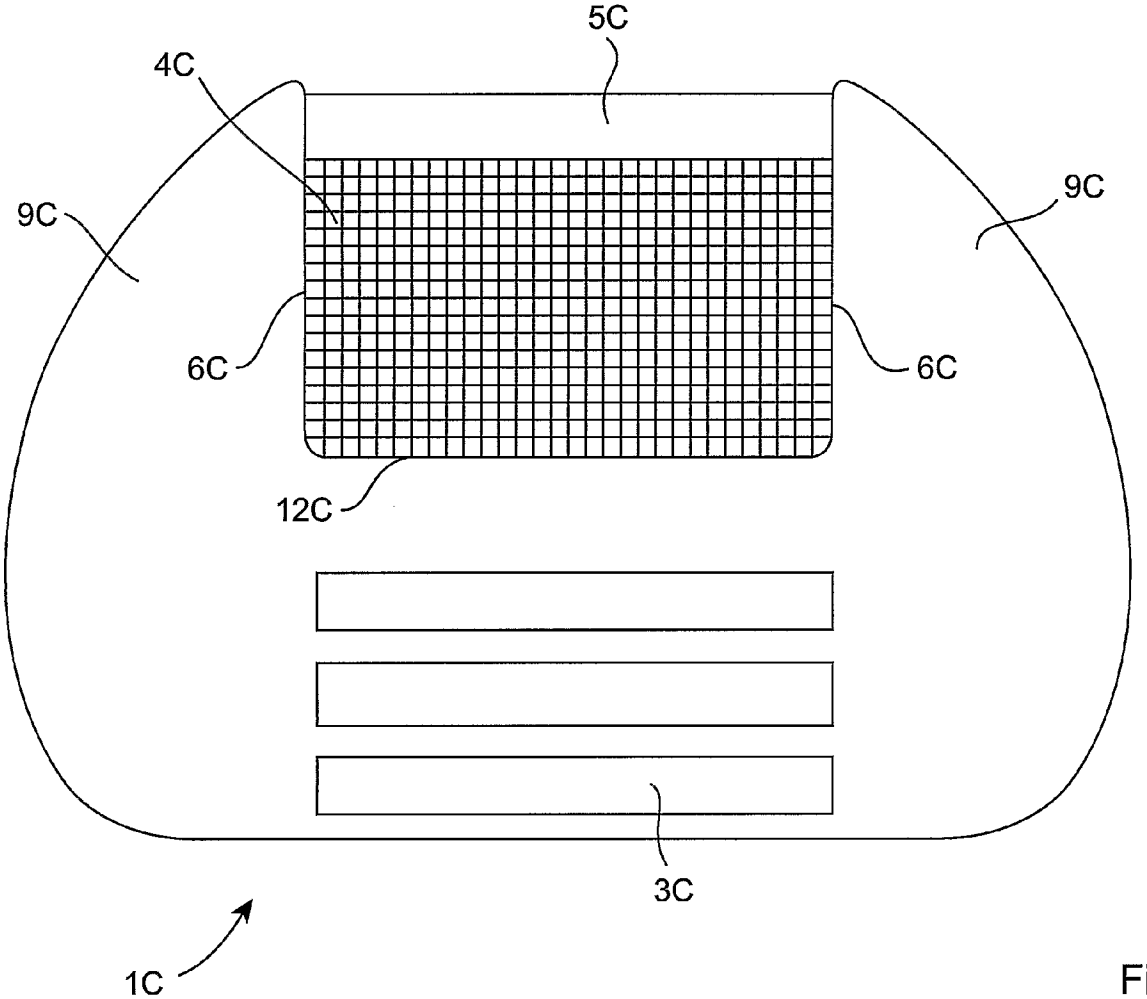
FIG. 24 shows a perspective view of an embodiment of the present invention in a cot configuration.

FIG. 24 shows a perspective view of an embodiment of the present invention in the cot configuration, suitable for a newborn baby up to, for example, a 12 month old child. The sofa (1C) is upholstered in padding and, for example, a soft, stretch fabric which is fire retardant, water resistant, stain resistant, anti-bacterial and anti-fungal and abrasion resistant. The fabric may also be leather, or the apparatus may be made of wood or rattan or plastic. This fabric will remain on the framework permanently. Loose, washable covers may also be used, for example, in organic cotton, bamboo or polyester.

There is a strong barrier at each point 6C of FIG. 1, which fastens to the mattress base. These two barriers prevent the baby from reaching beyond point 6C. The mattress base may compose wooden slats, fabric strips or a more rigid surface.

The netted drop side (4C) contains a horizontal board across the top, which may be covered with a plastic teething rail. This netted side is removable when the toddler is old enough not to need it to form a toddler bed or single bed. The netted drop side may be lowered with a one-handed mechanism and is pulled taughtly underneath the mattress base, instead of dropping down the side of the apparatus. The system for pulling the netted side (7C) and the actual lowered netted side is all contained neatly within the apparatus and hence only the top rail (5C) may be seen resting on the top ledge of the rim of the apparatus when in the lowered position. This lowered position may be suitable for babies who are very young and cannot yet roll over.

The opposite side of the apparatus to the netted side (4C) is the upholstered back of the sofa (2C in FIG. 25), which in one embodiment remains there permanently and is moulded into the sides of the apparatus so that the sides and back wall become one. This is preferably upholstered with wipe clean upholstery fabric, leather or vinyl. A washable cover may be provided for the mattress so that the sofa cot may be used as a sofa when the netted side is not in place.

The apparatus in FIG. 24 also shows a number of drawers (3C) to the front of the apparatus. There may be drawers in this space or, alternatively, a storage space, for example for storing another bed for temporary use, or pull-out play table. The drawers shown in FIG. 24 have no handles and are flush with the sides of the apparatus. The drawers must be pushed firmly to be released and opened.

The same concept applies to the top two curved sides of the apparatus (9C). These contain storage space and there will be a door or drawer which is flush with the sides and can be opened and closed by pushing against it firmly. These are optionally removable; when one side or lateral wall is removed, the cot becomes a small bed or toddler bed and when both are removed the bed becomes a single length bed.

The top of the mattress (8C) is flush with the open side of the apparatus (12C).

Figure 25:
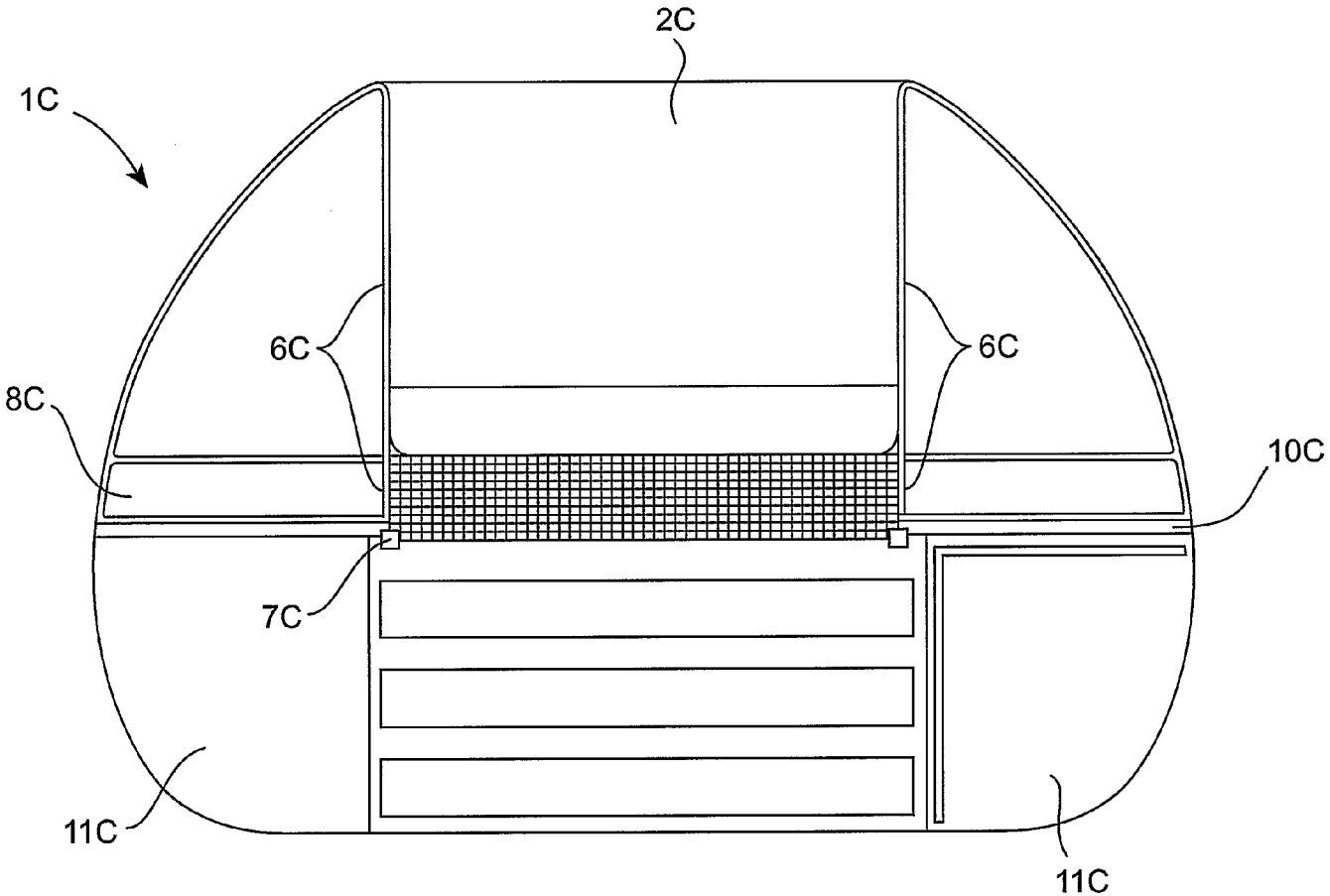
FIG. 25 is a cross-sectional view of the embodiment shown in FIG. 24.

As shown in FIG. 25, the mattress (8C) comes in 3 parts, which remain permanently on the mattress base (10C). Two side parts and one longer centre part. These breaks between the mattress segments allow for the barriers (6C) to be fastened to the mattress base. These barriers can be removed. One barrier may be removed simply to have a bigger surface area for the baby and so the netted drop side would remain in place. This configuration can alternatively be used when the child is old enough to move to a toddler bed. For the toddler bed configuration, the netted drop side/system (4C and 5C) is removed and one barrier (6C) is also removed. The second barrier (6C) may be removed when the toddler wishes to move into a longer single bed. Alternatively, both barriers may be removed when the apparatus is still in cot configuration with the netted side in place, should one wish to have a very large cot for the child or toddler to roll around in.

The domed sides (9C) may or may not incorporate netting windows within them, or even holes small enough for a baby not to become caught in.

The domed sides (9C) may also be detached from the apparatus, so the whole length of mattress could be seen, and reattached if needed.

The base (11C) of the apparatus may be solid for stability or hollow, to allow additional space for storage. One side of the base may also contain a pull out desk, attached to the apparatus. The other side may contain a stool, chair or beanbag. The apparatus may be mounted on wheels, so it can be easily repositioned within the room.

A cover that matches the sofa fabric is provided for the mattress, when the apparatus is to be used as a sofa.

The invention claimed is:

1. A sleeping unit, which is convertible from a young baby cot that is fully enclosed by a plurality of walls to prevent an occupant from getting out of the young baby cot of the occupant's own accord, to a bed including at least one of an older baby cot, a toddler bed, and/or a single bed that is not fully enclosed by the plurality of walls and from which the occupant is not prevented from getting out of the bed, by the repositioning of one or more of the plurality of walls, each of the plurality of walls comprising a rigid backboard supporting one or more upholstered panels substantially covering an inward-facing surface of the rigid backboard to prevent collisions between the occupant and the rigid backboard.

2. A sleeping unit according to claim 1 wherein one or more of the plurality of walls each comprises one or more viewing window(s).

3. A sleeping unit according to claim 2 wherein the one or more viewing window(s) each comprises a mesh or netting.

4. A sleeping unit according to claim 1 wherein the one or more upholstered panels are integrally formed on one or more of the plurality of walls of the sleeping unit.

5. A sleeping unit according to claim 1 wherein the one or more upholstered panels are reversibly attached to one or more of the plurality of walls of the sleeping unit.

6. A sleeping unit according to claim 5 wherein the one or more upholstered panels is reversibly attached to the one or more walls of the plurality of walls of the sleeping unit by interlocking means, said interlocking means comprising first and second elements which reversibly interlock together, one of said first or said second elements being provided in said one or more upholstered panels, and another of said first and said second elements being integral with or fixable to the rigid backboard comprising the one or more of the plurality walls of the sleeping unit.

7. A sleeping unit according to claim 6 wherein said first and second elements comprise a series of interlocking extrusions and apertures distributed over at least a substantial portion of a panel area of the one or more of the plurality of walls of the sleeping unit.

8. A sleeping unit according to claim 1 wherein the one or more upholstered panels comprises a resilient pad.

9. A sleeping unit according to claim 8 wherein the resilient pad comprises a polymeric foam, latex, coir or wadding.

10. A sleeping unit according to claim 1 wherein the one or more upholstered panels has a stain-resistant, wipe clean and/or washable cover.

11. A sleeping unit according to claim 1 wherein the one or more upholstered panels substantially covering an inward-facing surface of the rigid backboard to prevent collisions between the occupant and the rigid backboard is of a size and shape so as to form an entire wall of a sleeping unit.

12. A sleeping unit according to claim 1 comprising:— a. a base;

b. two cot side walls, the side walls being removable;

c. a cot headboard; and d. a cot baseboard, wherein the cot headboard and/or the cot baseboard is formed in at least two parts, such that in converting from the young baby cot that is fully enclosed by the plurality of walls to the bed that is not fully enclosed by the plurality of walls, at least one of the parts of the cot headboard and/or baseboard being removable and attachable to the base in place of the cot side wall to form bed side barriers that extend along a portion of a length of the base.

13. A sleeping unit according to claim 12, in which at least one of the headboard and/or baseboard is formed in two parts in a vertical orientation of the two parts, by division between the two parts in the vertical orientation, rotating the two parts to a horizontal orientation, and attaching the two parts to opposing sides of the base in place of the two cot side walls to form the bed side barriers.

14. A sleeping unit, which is convertible from a baby cot fully enclosed by a plurality of walls including a headboard, a footboard, and side walls, to a toddler bed, wherein the footboard for the baby cot is comprised of two panels in a vertical orientation that are removable to be used in a horizontal orientation as side rails partially extending along sides of the toddler bed.

15. A sleeping unit of claim 14, wherein each of the plurality of walls is formed by one or more upholstered panels on the interior side, supported on a rigid backboard.

16. A sleeping unit according to claim 15 wherein the one or more upholstered panels are integrally formed on one or more of the plurality of walls of the sleeping unit.

17. A sleeping unit according to claim 15 wherein the one or more upholstered panels are reversibly attached to the sleeping unit.

18. A sleeping unit of claim 14, wherein one or more of the plurality of walls includes one or more viewing windows.

19. A sleeping unit according to claim 18 wherein the viewing window comprises a mesh or netting.

20. A sleeping unit, which is a young baby cot, an older baby cot, a toddler bed, and/or a single bed, comprising one or more walls, said one or more walls comprising a rigid backboard supporting one or more upholstered panels, and wherein the sleeping unit further comprises:

a. an invertible and extendible base;

b. a headboard and a footboard (or baseboard), each insertable into the base; and c. optionally one or two lateral side walls positionable or positioned between the headboard and the footboard and which are optionally removable, and in which the base comprises a first receiving means to hold an inserted headboard and/or footboard at a first level when the base is in a first orientation, and a second receiving means to position an inserted headboard and/or footboard at a raised level compared with the first level when the base is inverted with respect to the first orientation.

* * * * *